US008540405B1

(12) United States Patent
Beck et al.

(10) Patent No.: US 8,540,405 B1
(45) Date of Patent: Sep. 24, 2013

(54) SYSTEMS, METHODS, AND DEVICES FOR INSTALLING LIGHT FIXTURES

(75) Inventors: Jeffrey Robert Beck, Farmingdale, NY (US); Vladimir T. Boulii, Huntington Station, NY (US)

(73) Assignee: Cooper Technologies Company, Houston, TX (US)

( * ) Notice: Subject to any disclaimer, the term of this patent is extended or adjusted under 35 U.S.C. 154(b) by 166 days.

(21) Appl. No.: 13/156,251

(22) Filed: Jun. 8, 2011

(51) Int. Cl.
*F21V 21/00* (2006.01)

(52) U.S. Cl.
USPC ..... 362/396; 362/382; 362/362; 362/217.13

(58) Field of Classification Search
USPC ..... 362/217.01–217.1
See application file for complete search history.

(56) References Cited

U.S. PATENT DOCUMENTS

| | | | | |
|---|---|---|---|---|
| 3,934,135 | A * | 1/1976 | Szer | 362/330 |
| 6,530,674 | B2 * | 3/2003 | Grierson et al. | 362/219 |
| 2010/0085768 | A1 * | 4/2010 | Pickett et al. | 362/368 |

* cited by examiner

*Primary Examiner* — Donald Raleigh
(74) *Attorney, Agent, or Firm* — King & Spalding LLP

(57) ABSTRACT

Light fixtures providing improved installation features and methods for installing such light fixtures are described herein. The light fixture may include a light fixture housing that forms a cavity and has a first end, a second end, and a connection means located at either the first end or second end of the housing. The connection means connects the light fixture housing to another light fixture housing. The light fixture further includes a light tray located in the cavity of the light fixture housing below the connection means. The light tray is hand-bendable to provide access to the interior components of the light fixture.

22 Claims, 6 Drawing Sheets

SYSTEMS, METHODS, AND DEVICES FOR INSTALLING LIGHT FIXTURES

TECHNICAL FIELD

The technical field of the exemplary embodiments relates generally to lighting solutions, and more particularly to systems, methods, and devices for installing light fixtures.

SUMMARY

According to an exemplary embodiment of the invention, there is disclosed a light fixture providing improved installation features. The light fixture may include a light fixture housing that forms a cavity and has a first end and second end, and a connection means (e.g., nut and bolt, screw, nail, adhesive, magnet, or other fastener) located at either the first end or second end of the housing, where the connection means connects the light fixture housing to another light fixture housing. The light fixture further includes a bendable light tray located in the cavity of the light fixture housing below the connection means.

In accordance with one aspect of the invention, the light tray shields the connection means from view from below the light fixture housing. In accordance with another embodiment of the invention, the light tray includes at least one lamp socket. According to another aspect of the invention, the light tray is L-shaped. In accordance with yet another embodiment of the invention, at least one lamp socket is located at one end of the L-shaped light tray. According to another aspect of the invention, the housing is a linear housing. In accordance with yet another embodiment of the invention, the connection means includes a nut and bolt. According to another aspect of the invention, the housing includes a bulkhead associated with the connection means. In accordance with yet another embodiment of the invention, the light tray includes at least one aperture for securing the light tray to the fixture housing. According to another aspect of the invention, the housing includes an alignment pin for aligning the housing with a second light fixture housing.

In accordance with another exemplary embodiment of the invention, there is disclosed a method for connecting two linear light fixtures that includes aligning a first end of a first fixture housing with a second end of a second fixture housing, and bending a light tray located in the first fixture housing such that the bending of the light tray exposes at least a portion of a bulkhead of the first fixture housing. The method includes connecting the first fixture housing with the second fixture housing through the use of a fastener associated with the bulkhead of the first fixture housing, and after connecting the first fixture housing with the second fixture housing, bending the light tray such that at least a portion of the light tray covers at least a portion of the bulkhead of the first fixture housing.

According to one aspect of the invention, the method may further include connecting a light source to a socket located on the light tray. In accordance with another aspect of the invention, aligning the first end of the first fixture housing with the second end of the second fixture housing includes using at least one alignment pin located at the first end of the first fixture housing engaging with the second end of the second fixture housing. According to yet another aspect of the invention, bending a light tray to expose a bulkhead of the first fixture housing located in the first fixture housing includes bending a light tray at a perforated bend point. In accordance with another aspect of the invention, bending the light tray to cover at least a portion of the bulkhead includes covering at least a portion of the fastener with the light tray. According to yet another aspect of the invention, connecting the first fixture housing with the second fixture housing through the use of a fastener associated with the bulkhead of the first fixture housing includes connecting the fastener with another bulkhead located in the second fixture housing.

In accordance with another aspect of the invention, connecting the first fixture housing with the second fixture housing through the use of a fastener associated with the bulkhead of the first fixture housing includes connecting the first fixture housing with the second fixture housing a bolt and nut as the fastener. According to yet another aspect of the invention, bending the light tray to cover at least a portion of the bulkhead further includes aligning the light tray of the first fixture housing with another light tray of the second fixture housing such that a first socket associated with the light tray of the first fixture housing is aligned with a second socket associated with the light tray of the second fixture housing. In accordance with another aspect of the invention, the method may further include securing the light tray to the first fixture housing. According to yet another aspect of the invention, securing the light tray to the first fixture housing includes driving a screw through an aperture located on the light tray.

BRIEF DESCRIPTION OF THE FIGURES

Figure 1B:
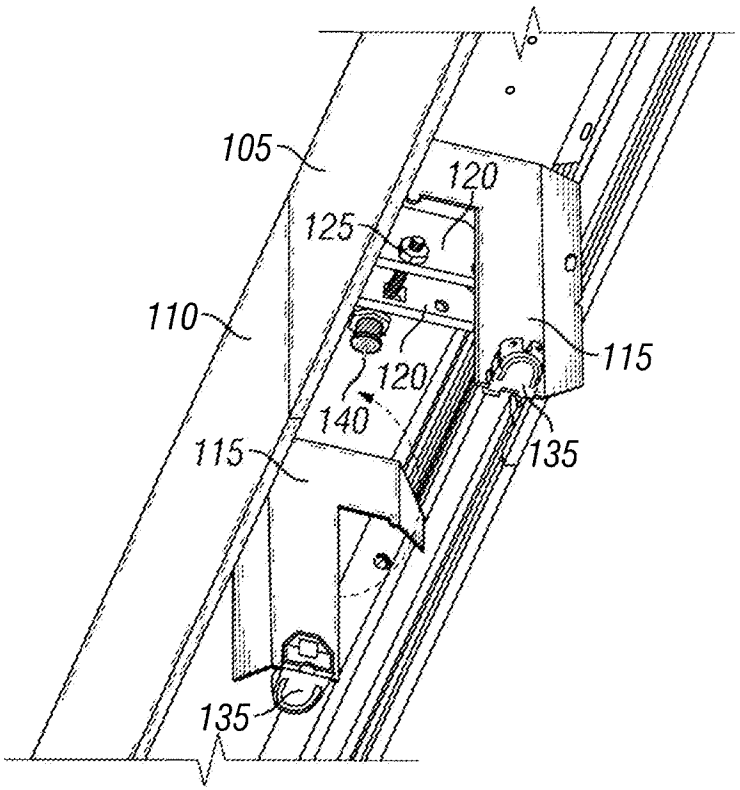
Figure 1A:
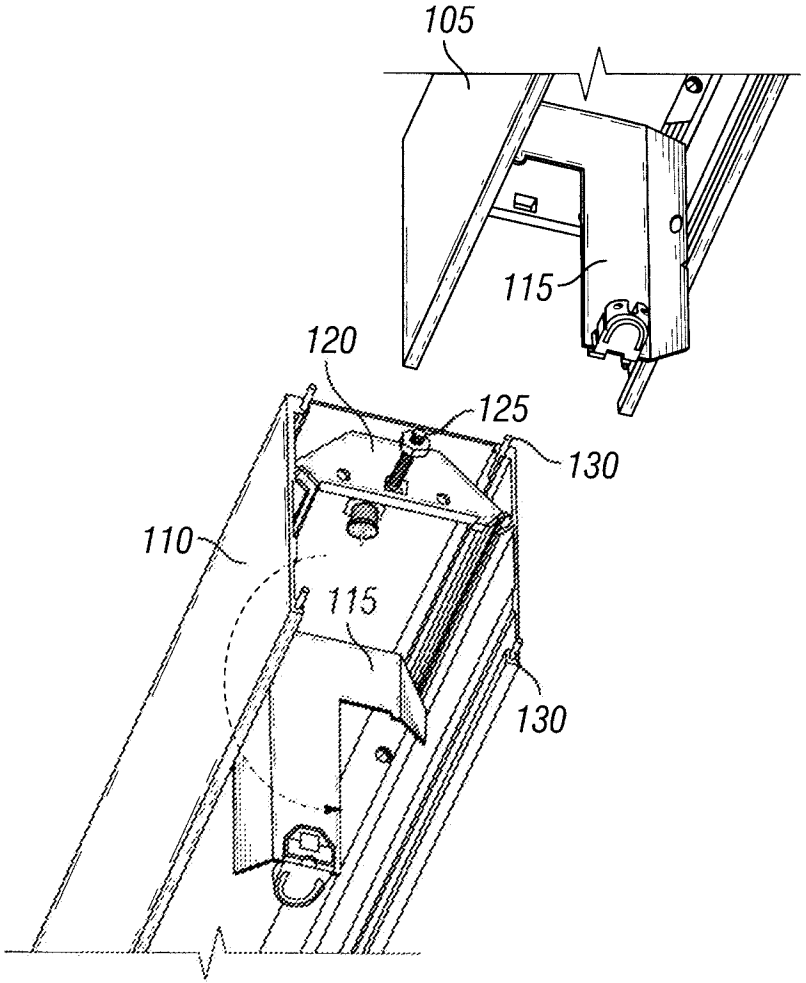

Having thus described the invention in general terms, reference will now be made to the accompanying drawings, which are not necessarily drawn to scale, and wherein:

FIGS. 1A and 1B illustrate the connection point between two light fixtures and bendable light trays providing access to the connection means for joining the two light fixtures in accordance with an example embodiment.

Figure 2:
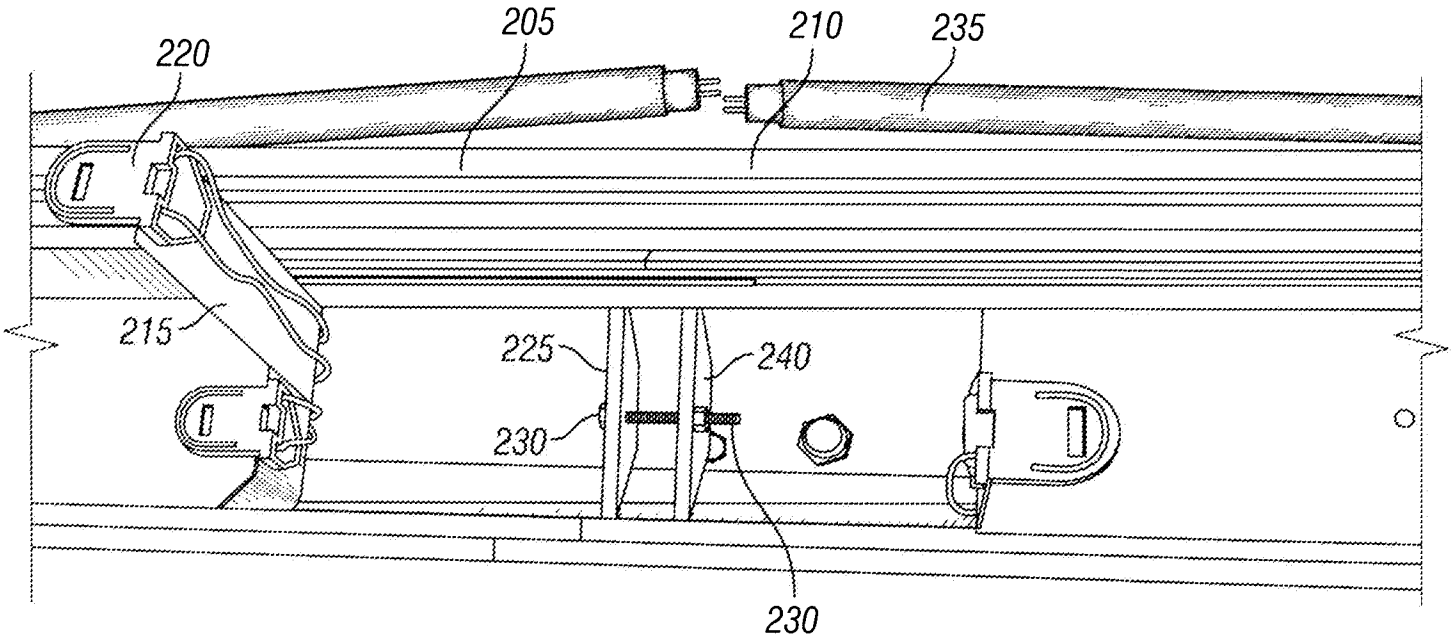

FIG. 2 illustrates bendable light trays during installation in accordance with an example embodiment.

Figure 3:
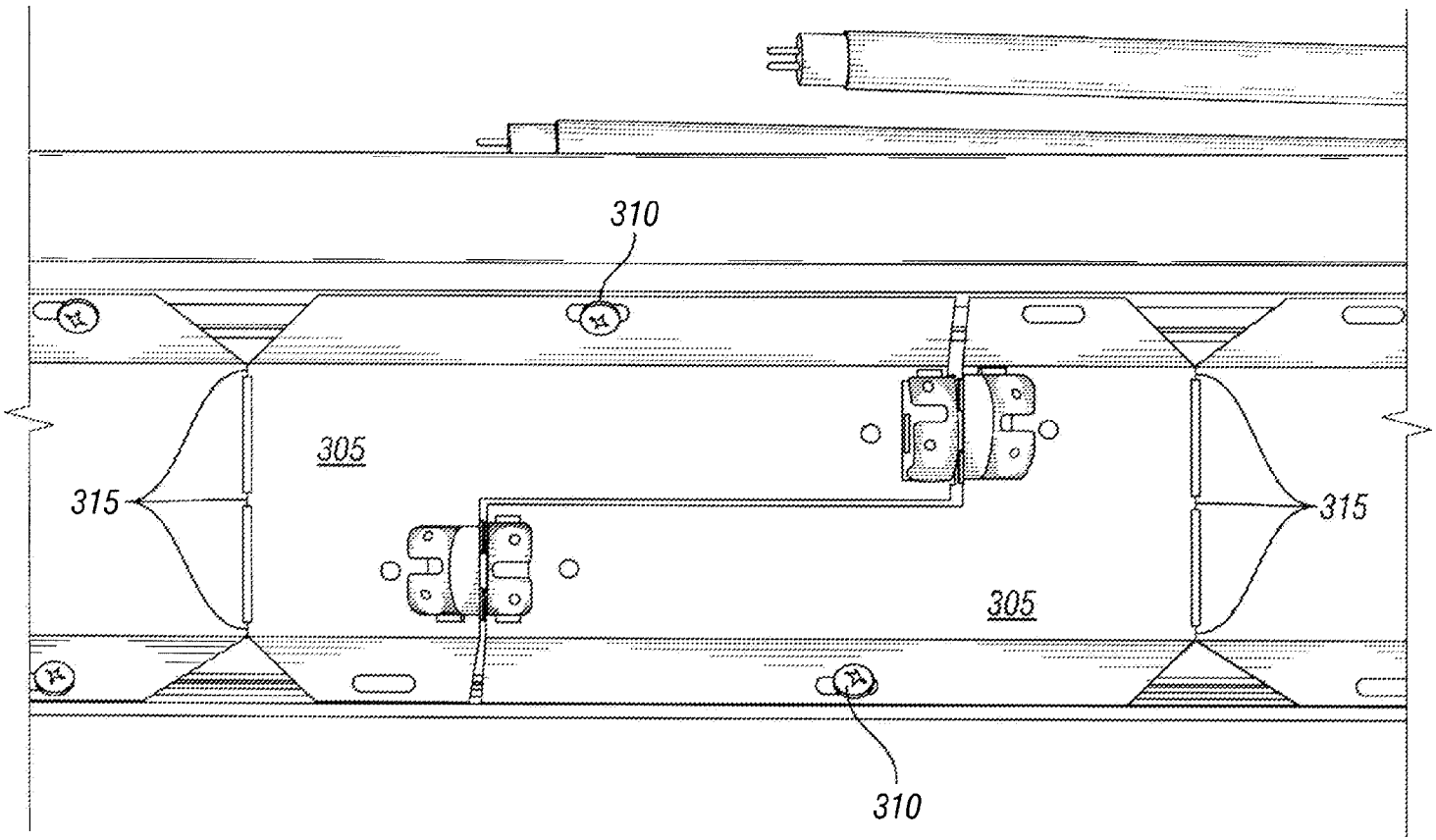

FIG. 3 illustrates light trays used for connecting two linear light fixtures in the installed position in accordance with one example embodiment.

Figure 4:
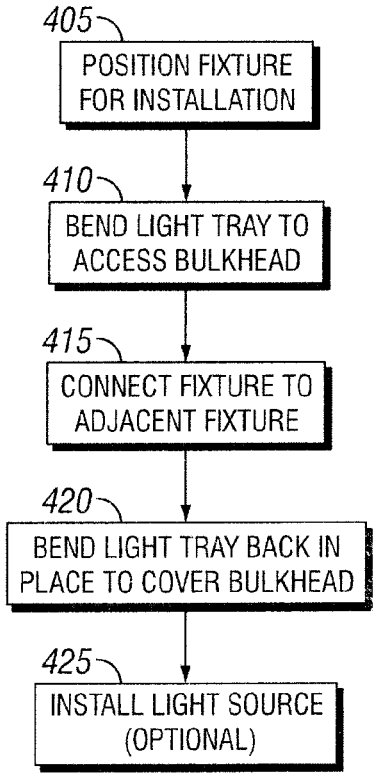

FIG. 4 presents a flowchart describing a process for the installing a light fixture using the bendable light tray in accordance with one example embodiment.

Figure 5:
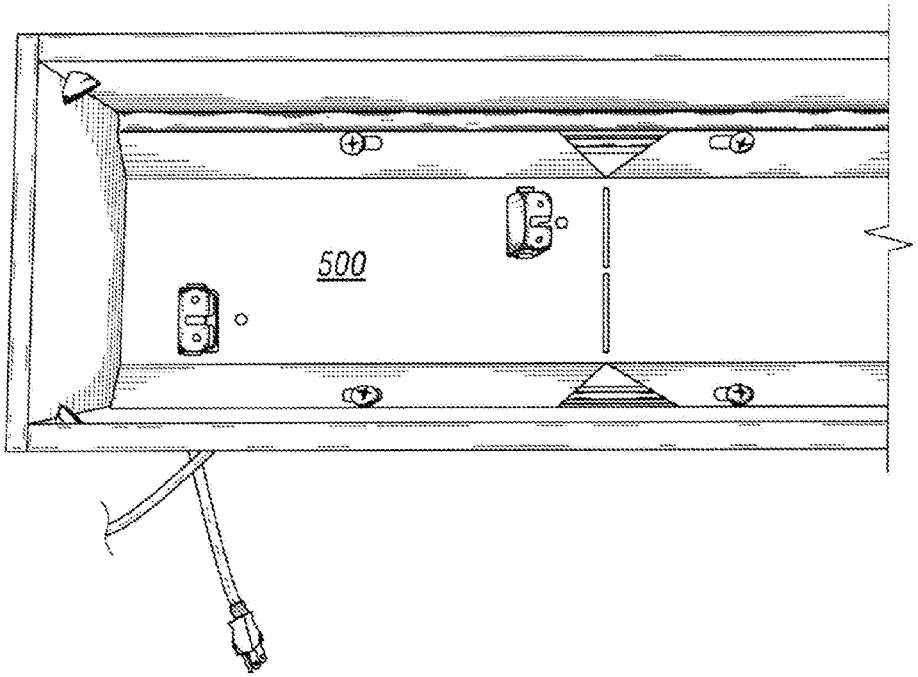

FIG. 5 illustrates an example light tray located at one end of a light fixture in the installed position in accordance with one example embodiment.

Figure 6:
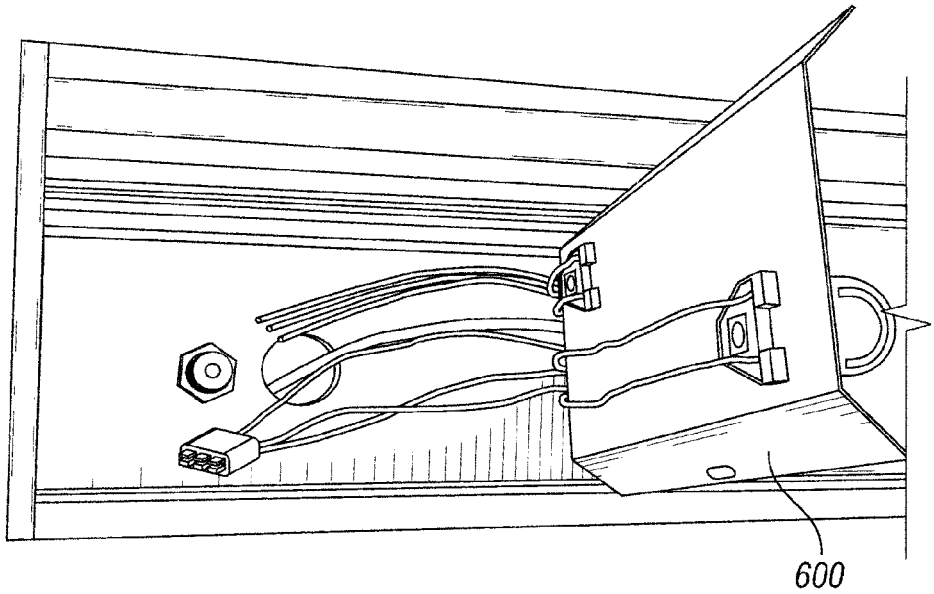

FIG. 6 illustrates an example light tray located at one end of a light fixture in the open position in accordance with one example embodiment.

DETAILED DESCRIPTION OF THE EXEMPLARY EMBODIMENTS

Light fixtures are sometimes installed in long linear runs along or suspended from a ceiling. During installation, the installer often has to install light fixtures that abut each other. Embodiments of the invention described herein are directed to the use of bendable light trays in light fixtures that allow an installer of the light fixture to bend the trays during installation to provide quick and easy access to the installation features of the light fixture during the installation process. The systems and methods described herein may provide several advantages including the ability to gain access to the inside of a light fixture without having to remove parts for installation of the fixture. The systems, methods, and apparatuses described herein may also provide easier installation methods for joining fixture sections into continuous runs and/or hanging fixtures into sheetrock.

Embodiments of the invention now will be described more fully hereinafter with reference to the accompanying drawings, in which example embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like, but not necessarily identical, elements throughout.

FIGS. 1A and 1B illustrate the connection point between two light fixtures and bendable light trays providing access to the connection means for joining the two light fixtures in accordance with an example embodiment. As shown in FIG. 1A, an end section of a light fixture housing 105 is being aligned with the end section of another light fixture housing 110 during the installation of one or both of the light fixtures. During the alignment process, aligner pins 130 may be used at the end of one light fixture to align both light fixtures and to allow for a substantially flush and/or contiguous installation of both fixtures. A member (e.g., bulkhead, plate, or bracket) 120 and a fastener 125 are located on the interior of the end of the first light fixture 110. The fastener 125 may be a carriage bolt and joiner nut or another fastener means such as a nail, screw, or the like. In one exemplary embodiment, the fastener 125 is disposed through an opening in the bulkhead 120.

Adjacent to the bulkhead 120 is a connector 140 located on the back wall of the fixture housing for connecting the housing to the ceiling or suspension system. In the example embodiment shown in FIGS. 1A and 1B, a light tray 115 is located on the interior of the light fixture housing below the bulkhead 120 (i.e., in front of the bulkhead 120 hiding it from view when looking up into the fixture housing from below). The light tray 115 may be shaped in a variety of different ways so as to fit within the fixture housing and/or shield the connector 140 from view from below the fixture. Additionally, other light fixture features, such as a socket 135, mounting apertures, etc. may be incorporated in or connected to the light tray 115. In the example embodiment shown in FIGS. 1A and 1B, the light tray 115 may be L-shaped and include a socket 135 for connecting to a light source such as a lamp, bulb, or LED module. The light tray 115 may be constructed from any material that allows for the light tray 115 to bend, such as sheet metal, plastic or another malleable and/or hand-bendable material. FIG. 1B shows a closer view of the bendable light trays 115 providing access to the connection means for joining two light fixtures shown in FIG. 1A.

FIG. 2 illustrates bendable light trays during installation in accordance with an example embodiment. In the example embodiment shown in FIG. 2, the light tray 215 of a first fixture 205 is bent back to reveal and allow access to the fixture bulkhead 225. At this point in the installation process, a fastener 230, such as the nut and bolt shown in FIG. 2, may be used to align and connect one fixture bulkhead 225 to the bulkhead 240 of an adjacent light fixture (or light fixture section) 210. As shown in FIG. 2, the light tray of the second light fixture 210 is also bent back to allow access to the bulkhead 240. Also shown in FIG. 2, is a light source 235 such as a lamp, bulb, LED module or the like that may be installed in front of the light tray, for example, once the installation process is completed and the light tray 215 is bent back into place.

FIG. 3 illustrates light trays 305, used for connecting two linear light fixtures, in the installed position in accordance with one example embodiment. As shown in the example embodiment of FIG. 3, the L-shaped light tray 305 of one fixture is aligned with the L-shaped light tray 305 of another fixture such that the sockets contained on each light tray 305 are aligned or substantially aligned. In one example embodiment, the light trays 305 are shaped in complimentary or corresponding shapes (e.g., male-female corresponding shapes, puzzle piece-like fit, etc.). During installation, once the light trays 305 are folded down and aligned, they may be held in place by a fastener 310 such as a screw through an aperture in the light tray 305 for connecting the light tray 305 to the housing or another connection means such as a nail, adhesive, magnet, or the like. In the example embodiment of FIG. 3, the bend points 315 are perforated (i.e., in one example embodiment, the bend points may be the segments between such perforations), thereby only allowing for a limited number of bends before the light tray 305 would snap off at the bend points 315. In example embodiments the perforations between the bend points 315 of the light tray 305 may be rectangular slots or another shaped aperture, such as, for example, round, square, triangular, obround, a slot, a slot and obround. The size of the apertures may be of a variety of lengths and widths so long as the light tray may bend out to expose the connection means for installation as well as bend back into place to at least partially cover the connection means during and/or after installation of the light fixture.

FIG. 4 presents a flowchart 400 describing a process for the installing a light fixture using the bendable light tray in accordance with one example embodiment. Referring now to FIGS. 1-4, the example process 400 begins at block 405 where the fixture is positioned for installation. In example embodiments, the fixture may be located on the room-side of a ceiling or wall, recessed into the ceiling or wall, or suspended from a ceiling or wall. The fixture may also be aligned with another light fixture (or another section of the same light fixture) to allow for a continuous run of light fixture housings and/or continuous light emitted from the fixtures.

Next, block 410 is invoked where the bendable light tray located on the interior of the light fixture is bended (or folded) back to reveal the connection point(s) for the light fixture housing and/or the fastener(s) for connecting two light fixtures (or light fixture sections) to one another. The installer then installs the fixture and/or connects the fixture to another adjacent fixture (or section) using the connection method provided behind the light tray in block 415. In one example embodiment, during installation, a nut and bolt on the bulkhead may be used as the connection means and may also pull two adjacent fixtures together as part of the connection process to provide a flush connection and/or consistent or continuous segments of light emitted by both light fixtures. Next, block 420 is invoked where the light tray is bent back into place to continue (or complete) installation of the fixture. In the example installation method of FIG. 4, block 425 may then be invoked where the light source, such as a lamp, bulb, LED module, etc. may then be installed in the fixture.

FIG. 5 illustrates an example light tray 500 having an alternative shape and located at one end of a light fixture, in the installed position in accordance with one embodiment. FIG. 6 illustrates an example light tray 600 having an alternative shape and located at one end of a light fixture, in the open position in accordance with one embodiment. The light trays shown in FIGS. 5 and 6 are examples of light trays that are not L-shaped. Additionally the light trays shown in FIGS. 5 and 6 are located at the end of a light fixture that does not connect to another light fixture (or light fixture section). As shown in the embodiment of FIG. 6, the light tray 600 has a bendable range of anywhere between 30 and 180 degrees and preferably at least 90 degrees from its installed position to allow access behind the light tray 600 during installation.

Accordingly, many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of this application. Although specific terms are employed herein, they are used in a generic and descriptive sense only and not for purposes of limitation.

The invention claimed is:

1. A light fixture comprising:

a light fixture housing forming a cavity and having a first end and second end;

a connection means located at either the first end or second end of the light fixture housing, wherein the connection means connects the light fixture housing to another light fixture housing; and a light tray located in the cavity of the light fixture housing below the connection means, wherein the light tray is bendable, wherein the light tray includes at least one lamp socket.

2. The light fixture of claim 1, wherein the light tray shields the connection means from view from below the light fixture housing.

3. The light fixture of claim 1, wherein the light tray is L-shaped.

4. The light fixture of claim 3, wherein at least one lamp socket is located at one end of the L-shaped light tray.

5. The light fixture of claim 1, wherein the housing is a linear housing.

6. The light fixture of claim 1, wherein the connection means includes a nut and bolt.

7. The light fixture of claim 1, wherein the housing includes a bulkhead associated with the connection means.

8. The light fixture of claim 1, wherein the light tray includes at least one aperture for securing the light tray to the fixture housing.

9. The light fixture of claim 1, wherein the housing includes an alignment pin for aligning the housing with a second light fixture housing.

10. A method of connecting two linear light fixtures comprising:

aligning a first end of a first fixture housing with a second end of a second fixture housing;

bending a light tray located in the first fixture housing, wherein the bending of the light tray exposes at least a portion of a bulkhead of the first fixture housing;

connecting the first fixture housing with the second fixture housing through the use of a fastener associated with the bulkhead of the first fixture housing;

after connecting the first fixture housing with the second fixture housing, bending the light tray, wherein bending the light tray covers at least a portion of the bulkhead of the first fixture housing with at least a portion of the light tray; and connecting a light source to a socket located on the light tray.

11. The method of claim 10, wherein aligning the first end of the first fixture housing with the second end of the second fixture housing includes using at least one alignment pin located at the first end of the first fixture housing engaging with the second end of the second fixture housing.

12. The method of claim 10, wherein bending a light tray to expose a bulkhead of the first fixture housing located in the first fixture housing includes bending a light tray at a perforated bend point.

13. The method of claim 10, wherein bending the light tray to cover at least a portion of the bulkhead includes covering at least a portion of the fastener with the light tray.

14. The method of claim 10, wherein connecting the first fixture housing with the second fixture housing through the use of a fastener associated with the bulkhead of the first fixture housing includes connecting the fastener with another bulkhead located in the second fixture housing.

15. The method of claim 10, wherein connecting the first fixture housing with the second fixture housing through the use of a fastener associated with the bulkhead of the first fixture housing includes connecting the first fixture housing with the second fixture housing a bolt and nut as the fastener.

16. The method of claim 10, wherein bending the light tray to cover at least a portion of the bulkhead further includes aligning the light tray of the first fixture housing with another light tray of the second fixture housing such that a first socket associated with the light tray of the first fixture housing is aligned with a second socket associated with the light tray of the second fixture housing.

17. The method of claim 10, further comprising securing the light tray to the first fixture housing.

18. The method of claim 17, wherein securing the light tray to the first fixture housing includes driving a screw through an aperture located on the light tray.

19. A method of connecting two linear light fixtures comprising:

aligning a first end of a first fixture housing with a second end of a second fixture housing;

bending a light tray located in the first fixture housing, wherein the bending of the light tray exposes at least a portion of a bulkhead of the first fixture housing and wherein bending a light tray to expose a bulkhead of the first fixture housing located in the first fixture housing includes bending a light tray at a perforated bend point;

connecting the first fixture housing with the second fixture housing through the use of a fastener associated with the bulkhead of the first fixture housing; and after connecting the first fixture housing with the second fixture housing, bending the light tray, wherein bending the light tray covers at least a portion of the bulkhead of the first fixture housing with at least a portion of the light tray.

20. The method of claim 19, wherein aligning the first end of the first fixture housing with the second end of the second fixture housing includes using at least one alignment pin located at the first end of the first fixture housing, the at least one alignment pin engaging with the second end of the second fixture housing.

21. A light fixture, comprising:

a first light fixture housing forming a cavity and having a first end;

a second fixture housing having a second end, wherein the first end of the first fixture housing and the second end of the second fixture housing are aligned with each other and wherein the first fixture housing is configured to be coupled to the second fixture housing through the use of a fastener associated with the bulkhead of the first fixture housing;

a light tray located in the first fixture housing, the light tray having a perforated bend point, wherein the light tray is bendable at the perforated bend point to expose at least a portion of a bulkhead of the first fixture housing and wherein the light tray is bendable to cover at least a portion of the bulkhead of the first fixture housing with at least a portion of the light tray after the first fixture housing is coupled to the second fixture housing.

22. The light fixture of claim 21, wherein the first end of the first fixture housing and the second end of the second fixture housing are aligned with each other using at least one alignment pin located at the first end of the first fixture housing that are engaged with the second end of the second fixture housing.

* * * * *